US006027614A

United States Patent [19]

Parker et al.

[11] Patent Number: 6,027,614

[45] Date of Patent: Feb. 22, 2000

[54] GENERATING A UNIQUE CREPE STRUCTURE

[75] Inventors: Peter Parker, Appleton; Thomas N. Kershaw, Neenah; Robert Marinack, Oshkosh, all of Wis.; Ranga Ramesh, Orange Park, Fla.; Frank Harper, Neenah, Wis.

[73] Assignee: Fort James Corporation, Deerfield, Ill.

[21] Appl. No.: 08/917,551

[22] Filed: Aug. 26, 1997

Related U.S. Application Data

[62] Division of application No. 08/741,775, Nov. 5, 1996.

[51] Int. Cl.[7] ..... B31F 1/14

[52] U.S. Cl. ..... 162/281; 15/256.51; 162/111

[58] Field of Search ..... 162/281, 111; 15/256.51

[56] References Cited

U.S. PATENT DOCUMENTS

| | | | |
|---|---|---|---|
| 1,673,921 | 6/1928 | Sharp | 15/256.51 |
| 1,803,909 | 5/1931 | Lodding et al. | 15/256.51 |
| 1,803,924 | 5/1931 | Vedder | 15/256.51 |
| 3,163,575 | 12/1964 | Nobbe | 162/281 |
| 3,866,266 | 2/1975 | Dunlap | 15/256.5 |
| 3,869,344 | 3/1975 | Hunt | 162/274 |
| 4,432,927 | 2/1984 | Van Tilburg et al. | 264/282 |
| 4,469,434 | 9/1984 | Yamazaki et al. | 355/15 |
| 4,639,123 | 1/1987 | Adachi et al. | 355/15 |
| 4,895,071 | 1/1990 | Benton | 101/169 |
| 4,919,756 | 4/1990 | Sawdai | 162/111 |
| 5,145,724 | 9/1992 | Yanai et al. | 15/256.51 |
| 5,224,995 | 7/1993 | Shibamoto | 118/249 |
| 5,520,731 | 5/1996 | Esser et al. | 118/126 |

FOREIGN PATENT DOCUMENTS

| | | | |
|---|---|---|---|
| 615517 | 1/1961 | Italy | 162/281 |
| 1419615 | 12/1975 | United Kingdom | 15/256.51 |

*Primary Examiner*—Peter Chin

*Attorney, Agent, or Firm*—Sixbey, Friedman, Leedom & Ferguson, PC; Charles M. Leedom, Jr.; Donald R. Studebaker

[57] ABSTRACT

A process for producing a creped sheet as well as a creping blade and creped paper product formed by such blade is set forth with the process including the steps of adhering a cellulosic web to a moving surface, providing a stepped creping blade disposed to crepe the cellulosic web from the moving surface and creping the cellulosic web from the moving surface forms a creped paper product having greater bulk and absorbency than previously prepared creped paper products. The stepped creping blade used in carrying out the process of the present invention includes an elongated body adapted to be engagable against, and span the width of, the moving surface, the elongated body having a cross section including a relief surface generally facing toward the moving surface, a back surface substantially parallel to the relief surface and generally facing away from the moving surface, a top surface adjacent both the relief surface and a recessed surface with the recessed surface being adjacent both the top surface and the back surface and forming a contact edge with the top surface such that the contact edge engages against the moving surface for creping the cellulosic web from the moving surface. The top surface and the recessed surface form a back step edge while the recessed surface and the back surface form a trailing edge. When utilizing such a blade configuration, the process further includes the steps of first contacting the cellulosic web conveyed by the moving surface with the contact edge, then optionally contacting the cellulosic web creped by the contact edge with the back step edge and subsequently contacting the cellulosic web creped by the contact edge with the trailing edge.

6 Claims, 8 Drawing Sheets

23
24
25
26
27
28
29
31
32
33
22
12
$W_s$
$D_s$

GENERATING A UNIQUE CREPE STRUCTURE

This is a Divisional application of Ser. No. 08/741,775, filed Nov. 5, 1996.

TECHNICAL FIELD OF THE INVENTION

The present invention generally relates to a stepped creping blade used to produce a creped paper product having increased bulk and increased absorbency. The present invention further relates to creped products such as tissues, towels, napkins and other personal products having increased bulk and increased absorbency as well as creping blades and the process for producing such products.

BACKGROUND OF THE PRESENT INVENTION

Paper is generally manufactured by dispersing cellulosic fiber in an aqueous medium and then removing most of the liquid. The paper derives some of its structural integrity from the mechanical interlocking of the cellulosic fibers in the web, but most by far of the paper's strength is derived from hydrogen bonding which links the cellulosic fibers to one another. With paper intended for use as bathroom tissue, the degree of strength imparted by this inter-fiber bonding, while necessary to the utility of the product, can result in a lack of perceived softness that is inimical to consumer acceptance. One common method of increasing the perceived softness and cushion of bathroom tissue is to crepe the paper. Creping is generally effected by fixing the cellulosic web to a Yankee dryer with an adhesive/release agent combination and then scraping the web off the Yankee dryer by means of a creping blade. Creping, by breaking a significant number of inter-fiber bonds in a formed web, adds to and increases the perceived softness of resulting paper product. More specifically, in a typical creping operation, the web is pressed with a smooth roller onto a heated polished metal drying drum, such as the Yankee dryer, while it is partially wet and before final drying. The heat of the drying drum and the pressing with the roller cause the web to adhere to the surface of the cylinder. After the moisture in the web has evaporated, the dried web is creped off the cylinder by a creping blade. However, creping with a conventional creping blade alone may not be sufficient to impart the desired bulk, absorbency, and tactile characteristics.

Conventional creping blades have a flat top surface that is usually ground to give a reasonably smooth, flat surface. The width, W, of a conventional creping blade having a flat top surface is given by:

$$W = T/\cos(\theta)$$

wherein the blade has a bevel of θ degrees and T is the thickness of a cross section of the blade. Very limited literature data indicate that the fineness of a crepe (as measured by crepes/unit length) can be increased by decreasing the thickness, T, of the blade. However, it is well recognized that as the fineness of the crepe increases, the bulk of a resulting sheet decreases. It is unclear whether the creping angle was controlled when thin blades were used. However it is known that if the thin blades flex, the creping angle increases causing the fineness of the crepe to increase. Current understanding is that the fineness of the crepe is inversely related to the thickness of the blade, at a constant creping angle.

Because the flexural rigidity of a thin blade is low, a backing blade must often be used with a thin creping blade to increase its apparent stiffness and prevent it from bending unduly under forces necessary for creping. In order to overcome such a shortcoming, the present invention provides a stepped creping blade, which combines the characteristics of the relatively thin width of a thin creping blade with the stiffness of a thick blade. The stepped creping blade of the present invention does not need to be used with a backing blade because the stepped creping blade has the stiffness of a thick blade.

The present invention is directed to creped paper products such as napkins, towels, or tissues, having increased bulk and increased absorbency which are produced by a process similar to conventional processes, however, a conventional crepe blade is replaced with a stepped creping blade. The stepped creping blade can be manufactured by machining or grinding a step into a conventional blade. In accordance with the present invention, the width of the step's top surface is from 20% to 60% of the total width and the depth of the step is from 30% to 300% of the top surface (0.030 to 0.030). Preferably, the depth of the step is about 0.010 to 0.030 inches and the width of the step's top surface is about 0.010 to 0.040 inches.

In this regard, U.S. Pat. No. 5,520,731 to Esser et al. discloses a doctor blade with a shape similar to a step; however, this doctor blade is used in coating processes as a squeegee to wipe excess ink off an applicator roll. Coating processes are unlike and unrelated to creping processes. In addition, the Esser et al. doctor blade has a chamfered metering surface which is angled so that a portion of the blade's surface, rather than just an edge of the blade, is engaged against an applicator roll for coating a web which is adhered to the applicator roll. Similarly, U.S. Pat. No. 4,184,429 to Widmer discloses a doctor blade much like the Esser et al. blade. U.S. Pat. No. 4,895,071 to Benton discloses a doctor blade having a reduced thickness section for use in the field of gravure printing. The Benton blade has a beveled surface, and is designed to control an amount of ink transferred from a printing surface of a gravure cylinder to a web. The direction of the bevel in the doctor blade surfaces that engage against a cylinder in the Esser et al., Widmer, and Benton patents prevent these blades from being used as a creping blade which produces a creped sheet having increased bulk and increased absorbency. U.S. Pat. No. 5,408,926 to Alder discloses a prior art doctor blade which appears to have a stepped shape. However, the doctor blade of the Alder patent is used in pad transfer printing to scrape excess ink from a working surface. In addition, the blade of the Alder patent is not designed to extend the length of a moving surface, such as a Yankee dryer, in order to crepe a cellulosic web from the moving surface.

U.S. Pat. No. 4,185,399 to Gladish discloses a creping blade having first and second surfaces that are substantially perpendicular to a surface of a Yankee dryer wherein the first surface crepes a web off the Yankee dryer. However, the first surface and the second surface are not parts of a single blade body. In addition, a flow of air is forced between the first surface and the second surface of the Gladish blade.

There is a need for a creping blade and method for producing creped paper products such as napkins, towels or tissues having increased bulk and increased absorbency without increasing the thickness of the paper product but merely by altering the structure of the creping blade itself.

SUMMARY OF THE INVENTION

A primary object of the present invention is to overcome the aforementioned shortcomings associated with prior art devices and processes.

It is an object of the present invention to provide a creping blade for creping a cellulosic web from a moving surface such as a Yankee dryer so as to achieve an improved paper product.

More specifically, it is an object of the present invention to provide a creping blade that is used to produce a creped sheet having increased bulk and increased absorbency.

Another object of the present invention is to provide a creping blade that may be readily manufactured by machining or grinding a step into a conventional creping blade.

It is another object of the present invention to provide an improved creped paper product having increased bulk and increased absorbency that is manufactured using such a stepped creping blade.

In accordance with the present invention, creped paper products such as napkins, towels, or tissues, having increased bulk and increased absorbency are produced by a process similar to conventional processes by substituting a stepped creping blade for previously known blade configurations. The stepped creping blade can be manufactured by machining or grinding a step into a conventional blade.

These as well as additional objects of the present invention are achieved by process for producing a creped sheet including the steps of adhering a cellulosic web to a moving surface, providing a stepped creping blade disposed to crepe the cellulosic web from the moving surface and creping the cellulosic web from the moving surface. The stepped creping blade used in carrying out the process includes an elongated body adapted to be engagable against, and span the width of, the moving surface, the elongated body having a cross section including a relief surface generally facing toward the moving surface, a back surface substantially parallel to the relief surface and generally facing away from the moving surface, a top surface adjacent both the relief surface and a recessed surface with the recessed surface being adjacent both the top surface and the back surface and forming a contact edge with the top surface such that the contact edge engages against the moving surface for creping the cellulosic web from the moving surface. The top surface and the recessed surface form a back step edge while the recessed surface and the back surface form a trailing edge. The process further includes first contacting the cellulosic web conveyed by the moving surface with the contact edge, then, optionally, contacting the cellulosic web creped by the contact edge with the back step edge and subsequently contacting the cellulosic web creped by the contact edge with the trailing edge.

The foregoing as well as additional advantages of the present invention will become apparent from the following detailed description when read in light of the several figures.

DETAILED DESCRIPTION OF THE PREFERRED EMBODIMENTS

Initially, it should be noted that like numerals of reference designate like parts in the different embodiments and different views.

Figure 1C:
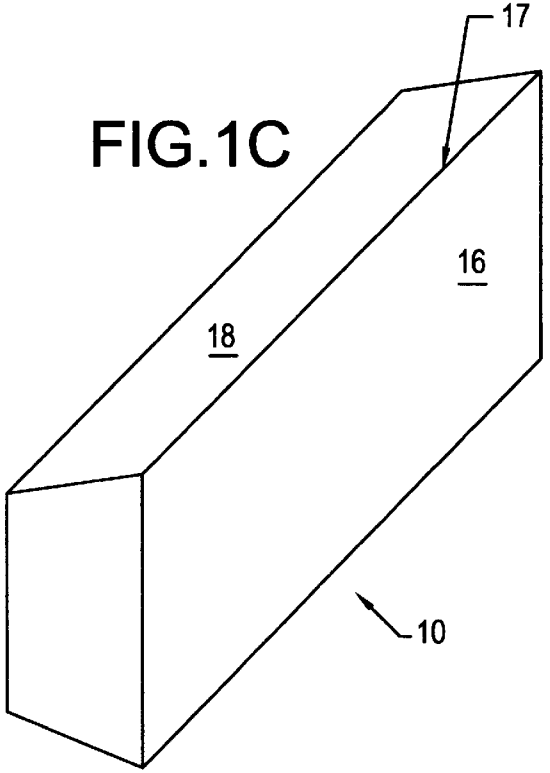
FIGS. 1A, 1B and 1C illustrate three views of a conventional creping blade having a bevel of θ degrees as measured between a front surface and a line drawn perpendicular to the relief surface.
Figure 1B:
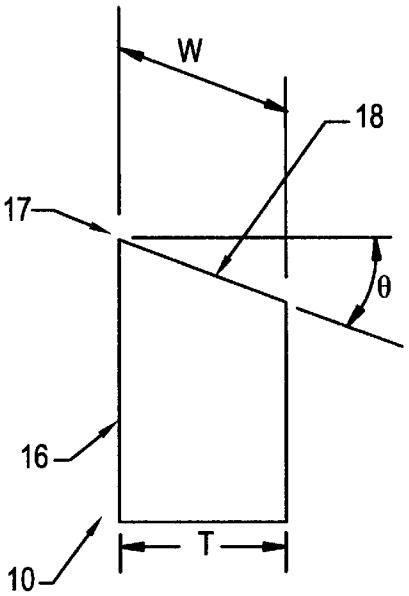
Figure 1A:
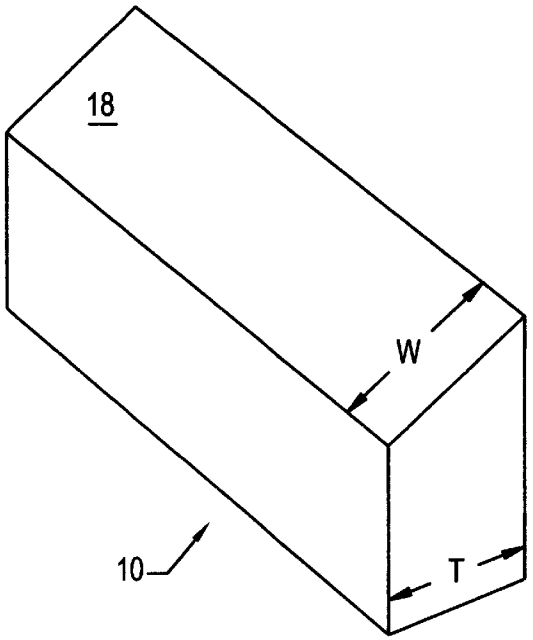
Figure 2C:
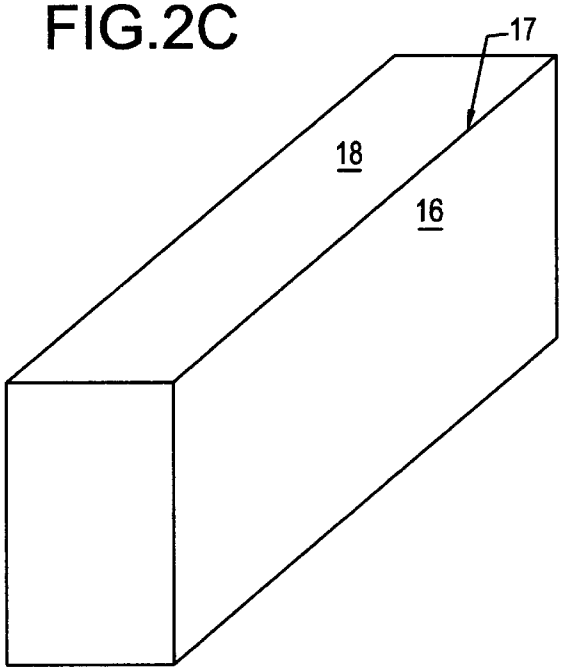
FIGS. 2A, 2B, and 2C illustrates three views of a square blade, which is a conventional creping blade having a bevel of zero degrees.
Figure 2B:
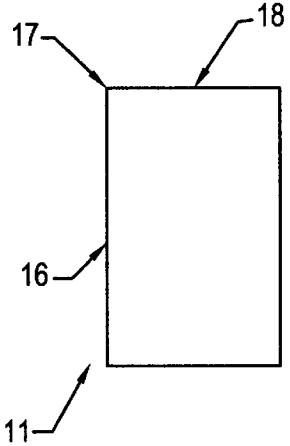
Figure 2A:
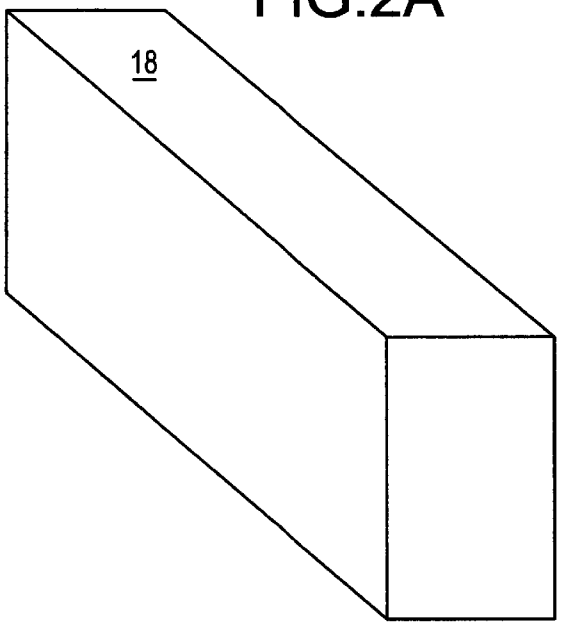

FIGS. 1A–1C illustrate a portion of a conventional creping blade 10 having a contact edge 17 between a top surface 18 and front surface 16. The contact edge 17 is engaged against a moving surface, such as a Yankee dryer (not shown), to crepe a cellulosic web from the moving surface. The conventional creping blade 10 has a bevel of θ degrees as measured between the front surface 16 and a line drawn perpendicular to the front surface. A width W of the conventional creping blade's top surface is defined as $$W = T/\cos(\theta)$$

wherein T is the thickness of the blade. Similarly, FIG. 2A–2C illustrates a square blade, which is a conventional creping blade having a bevel of zero degrees. The conventional creping blades have a thickness of approximately 0.035% to 0.050 inches.

FIGS. 3A–3C, and FIGS. 4A–4C illustrate a portion of the stepped creping blades 12 and 13 useable in the practice of the present invention. There are two ways to manufacture the stepped creping blades. First, the step can be machined into the square blade 11 of FIG. 2, to give the machined step creping blade 12 shown in FIGS. 3A–3C. The machined stepped creping blade 12 has upper surface 33 which includes a top surface 28 and a recessed surface 29. The recessed surface 29 of the machined embodiment includes a side surface 31 and a bottom surface 32. Machining results in a well defined step, but the machining of steel used for creping blades is a time consuming task. Alternatively, a grinder could be used to develop the ground stepped creping blade 13 shown in FIGS. 4A–4C. The upper surface 33 of the ground stepped creping blade 13 also includes a top surface 28 and a recessed surface 29. However, the recessed surface 29 of the ground embodiment is substantially arced or curved. Grinding is a much simpler operation and more conducive to commercial manufacture of the stepped creping blade. The curvature of the step is controlled by the thickness of a grinding wheel.

A front surface 26 generally faces toward a moving surface (not shown), such as a Yankee dryer. A back surface 27 is substantially parallel to the front surface 26 and generally faces away from the moving surface. The front surface 26 and the top surface 28 form a contact edge 23 which is engaged against the moving surface to crepe a cellulosic web from the moving surface. The top surface 28 and the recessed surface 29 form a back step edge 24. The recessed surface 29 and the back surface 27 form a trailing edge 25. Body 22 extends indefinitely in length, typically exceeding 100 inches in length and often reaching over 26 feet in length to correspond to the width of a Yankee dryer on more modern paper making machines. In contrast, the thickness of the body 22 is usually on the order of fractions of an inch, e.g. 0.050 inches.

The machining or grinding of a top surface of the square blade forms a step having a depth $D_s$ and a top surface having a width $W_s$. In accordance with the present invention, the width, $W_s$, of the step's top surface is from 20% to 60% of the total width of the blade and the depth, $D_s$, of the step is from 100% to 300% of the top surface. Preferably, the width $W_s$ of the step is approximately 0.010 to 0.040 inches, and the depth $D_s$ of the step is approximately 0.010 to 0.030 inches; however, the particular dimension will be dependent on the final paper product desired. Preferably, the step extends the entire length of the body 22 of the creping blades as shown in FIGS. 3A and 3C and FIGS. 4A and 4C.

Figures 3A, 3B, 3C:
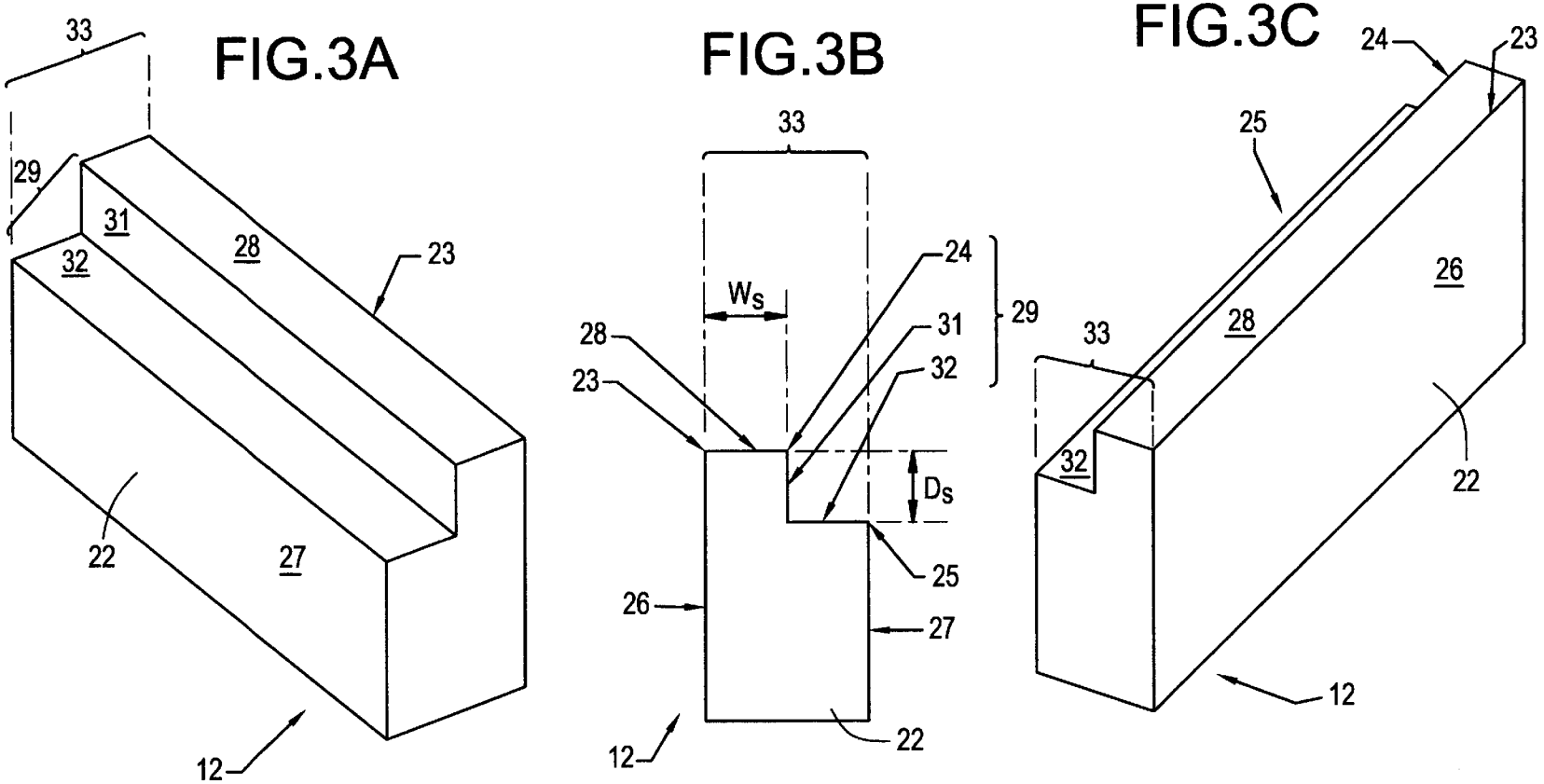
FIGS. 3A, 3B and 3C illustrate three views of a machined stepped creping blade of the present invention.
Figure 4C:
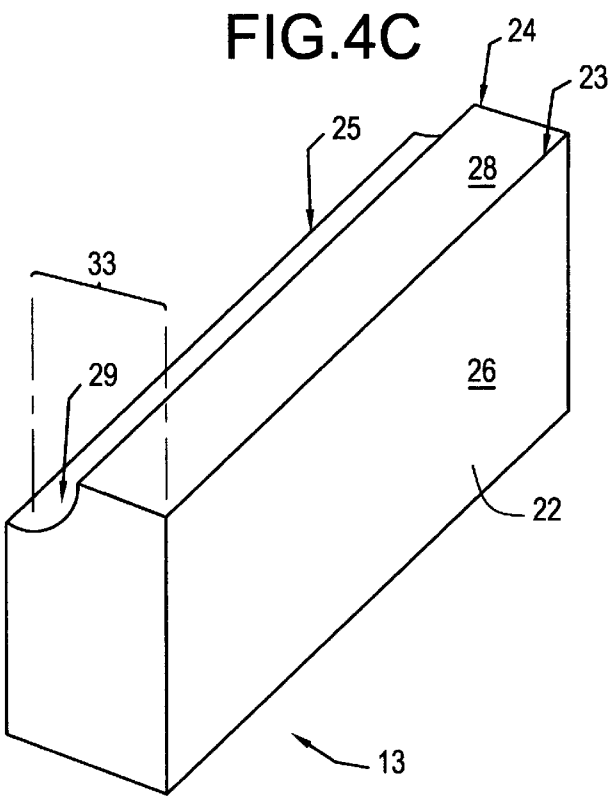
FIGS. 4A, 4B and 4C illustrate three views of an alternative stepped creping blade of the present invention.
Figure 4B:
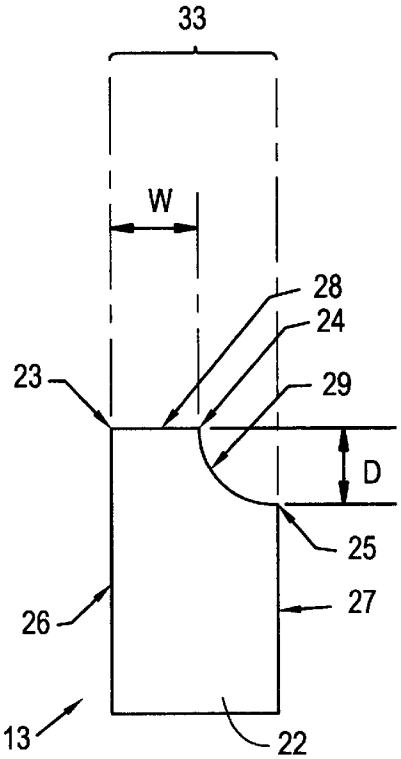
Figure 4A:
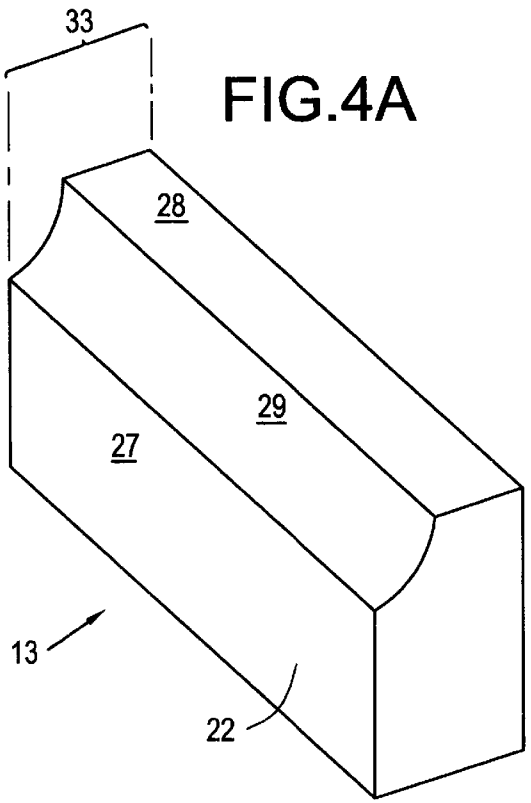

Machining the square blade removes a substantially rectangular portion from the cross section of the square blade and therefore results in a substantially rectangular recessed surface 29 as shown in FIGS. 3A–3C. Grinding the square blade removes a substantially arced or curved portion of the square blade and therefore results in a substantially arced or curved recessed surface 29 as shown in FIGS. 4A–4C.

Figure 5A:
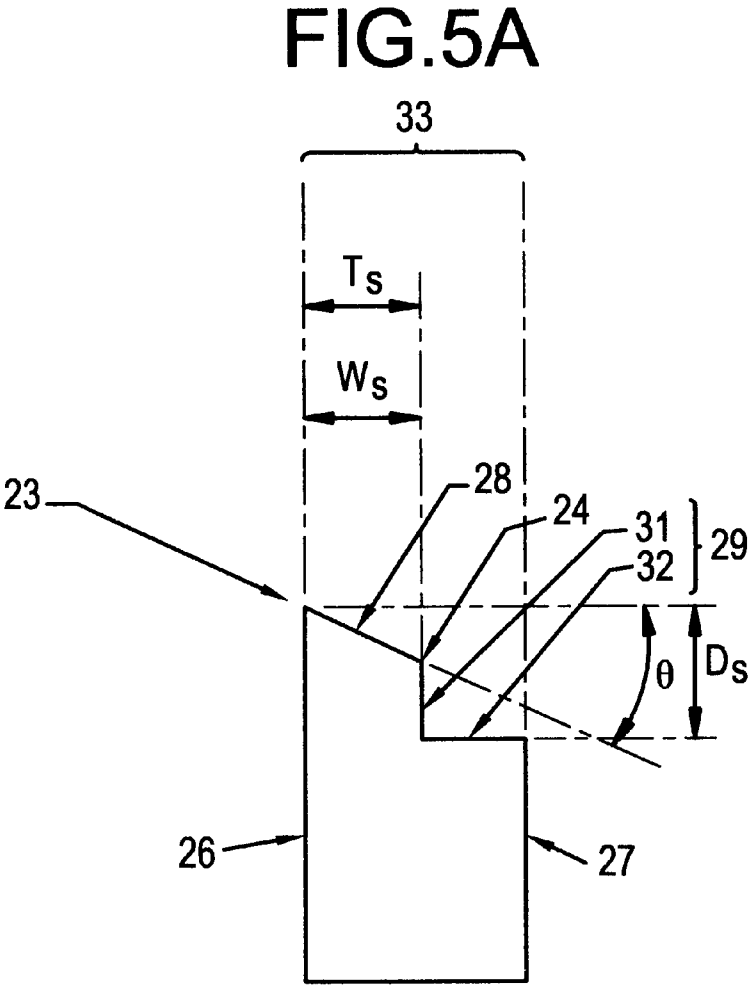
FIGS. 5A and 5B illustrate side views of further alternative embodiments of the stepped creping blades of the present invention wherein a top surface of each step has a bevel of θ degrees as measured between a front surface and a line drawn perpendicular to the front surface.
Figure 5B:
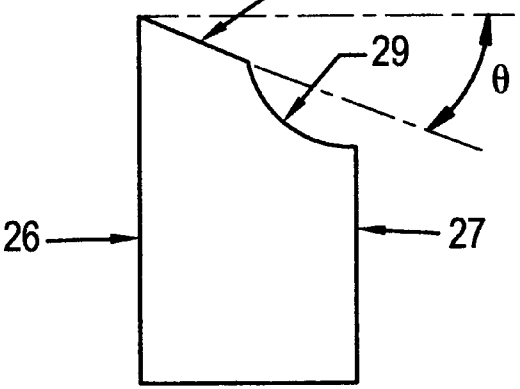

FIGS. 5A and 5B illustrate cross sectional views of alternative embodiments 14 and 15 of the stepped creping blades of the present invention wherein the top surface 28 of each step has a bevel of θ degrees as measured between the front surface 26 and a line drawn perpendicular to the relief surface. This stepped creping blade can be manufactured by machining or grinding a step into the conventional creping blade of FIGS. 1A–1C. This stepped creping blade can also be manufactured by adding a bevel to the stepped creping blade of FIGS. 3A–3C and FIGS. 4A–4C. $T_s$ is a perpendicular distance from the relief side 26 to a back edge 24. The stepped creping blades shown in FIGS. 5A and 5B have a depth $D_s$ and a top surface Width $W_s$ wherein $$W_{s} = T_s/\cos(\theta).$$

Figure 6:
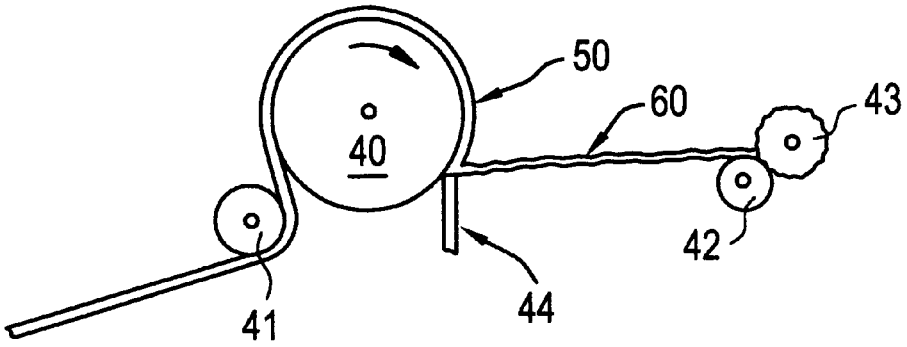
FIG. 6 illustrates a side elevation view of the drier end of a papermaking machine including a drier drum and a creping blade for creping paper from the drum.

The environment in which the present invention is particularly adaptable is illustrated in FIG. 6. As shown in FIG. 6, a drier end of a typical papermaking machine generally includes a Yankee dryer drum 40 rotating engagingly with the creping blade 44. A cellulosic web 50 is applied on an outer surface of the drum 40 and is dried by the drum during less than a single revolution thereof. A guide cylinder 41 presses the cellulosic web 50 against the rotating drum 40, whereby the web 50 transfers from the guide cylinder 41 to the drum 40. A creping blade 44 is utilized for creping the paper web from the surface of the drum 40 in the manner described below. The creped web, also known as the base sheet, can then be wound up on a wind-up reel 43 with the assistance of a guide roller 42.

Figure 7:
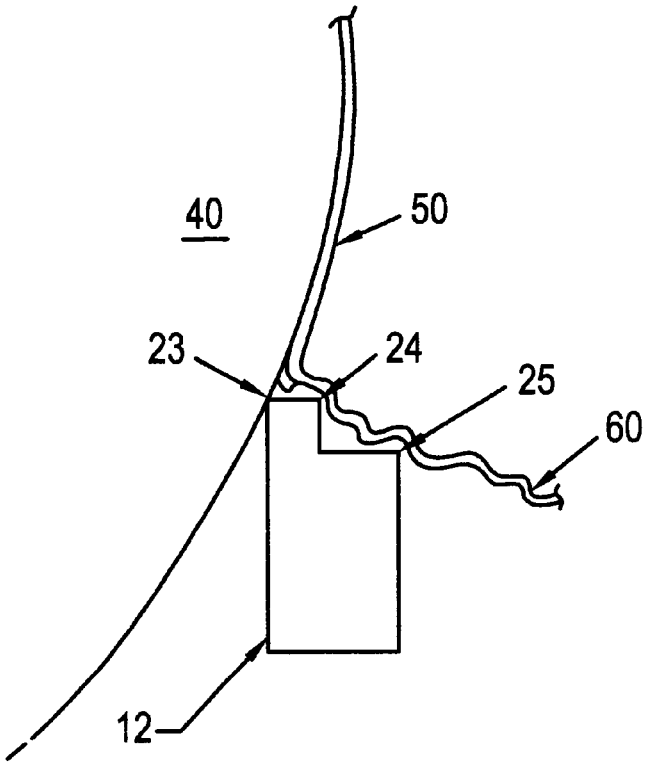
FIG. 7 illustrates the stepped creping blade of the present invention creping a cellulosic web from a drier drum.

With reference now to FIG. 7, FIG. 7 illustrates the creping process of the present invention. As the drum 40 rotates in the clockwise manner, the cellulosic web 50 is removed from drum 40 and is creped by contact edge 23 of the stepped creping blade 12 forming a creped sheet 60. After being formed, the creped sheet 60 is pushed off the back step edge 24 of the creping blade and optionally onto a trailing edge 25 of the creping blade. It is believed that friction between the creped sheet 60 and the back edge 24 retards the creped sheet 60 causing macro-folds to build. Of course, the other embodiments of stepped creping blades of the present invention may also be used in the creping process.

In carrying out the above process in accordance with the present invention, an increase in the bulk and absorbency of the paper web is associated with the presence of the step of the stepped creping blade. The step of the creping blade acts as a thin creping blade, but since the depth of the step is small, the stepped creping blade has a stiffness of a thick blade. The step also produces a creped sheet having crepes of more uniform size and shape resulting in improved tactile characteristics as will be discussed in greater detail hereinbelow. In addition, the trailing edge 25 of the creping blade causes macro-folds to build in the creped sheet. A still further unique aspect of the stepped creping blade is that it generates very long-cross machine direction crepes. Again, such aspects will be discussed in greater detail hereinbelow.

As will be apparent to those skilled in the art, the stepped creping blade of the present invention can be used in various known types of creping processes including wet crepe processes and Through-Air-Drying (TAD) processes. The stepped creping blade of the present can also be used in the production of a double or a recreped sheet.

The paper products prepared by utilizing the stepped creping blade in accordance with the present invention, can be prepared using any suitable conventional furnish such as softwood, hardwood, recycle, mechanical pulps, anfractuous fibers and combinations of these.

The following data illustrates the beneficial effects on a creped paper product achieved in accordance with the present invention.

Experimental Results

Table 1 presents a summary of the process conditions for test which were carried out to compare creping characteristics of the stepped creping blades of the present invention with conventional square creping blades having a bevel of zero degrees.

TABLE 1

| Furnish: | |
|---|---|
| Hemlock | 40% |
| Alder | 40% |
| Sawdust | 20% |
| OD Basis Wt | 17.4 |
| Moisture | 4.0 |
| Refiner | 31 hp |
| Wet End Hood Temp. | 552 degrees F |
| Dry End Hood Temp. | 502 degrees F |
| Jet:Wire Ratio | 1.13 |
| Yankee Speed | 1647 fpm |
| Reel Speed | 1430 fpm |
| Crepe | 13% |
| Kymene 557 ® Addition | 5 #/t |
| Crepe Adhesive: | |
| Houghton 82–176 ® | 4.2 #/t |
| Crepe Release Aid: | |
| Houghton 565 ® | 0.15 #/t |

Table 2 presents the data accumulated from the tests. Three conventional square creping blades, similar to the blades shown in FIGS. 2A–2C, were tested for use as the control for the experiment. Four machine stepped creping blades and two ground stepped creping blades were tested.

The top surfaces of the machined and ground stepped creping blades were substantially perpendicular to the relief surfaces. The side surfaces of the machined stepped creping blades were substantially parallel to the relief surfaces. The machined stepped creping blades tested were of the embodiment shown in FIGS. 3A–3C. The ground stepped creping blades tested were of the embodiment shown in FIGS. 4A–4C. The approximate width of the top surfaces of the conventional square creping blades and the square creping blades from which the stepped creping blades were machined or ground was 0.050 inches. Each machined and ground stepped blade is defined by the portion of the square blade which was removed, through machining or grinding, to produce the step. The Type of Blade column identifies the tested blades as either Conventional Square Blades, which are control blades, Mach, which are machined stepped blades, or Grnd, which are ground stepped blades. S is the width of the portion of the top surface of the square blade which was removed to create the step. Therefore, the width $W_s$ of the top surface of each of the tested stepped creping blades is defined as $$W_s = 0.050 - S \text{ (inches)}.$$

For example "Mach: S=0.010; D=0.010" is a machined stepped creping blade having a top surface width of approximately 0.040 inches. D is the depth of the back surface which was removed to create the step. Each stepped creping blade is also identified by a Blade Code.

TABLE 2

| | Blade Code | Basis Wt. | AGAT Cap | AGAT Rate | Porofil | Bulk, $\mu$ | Voids | Meas. S[1] | Meas. D[1] |
|---|---|---|---|---|---|---|---|---|---|
| Conventional Square Blade | Sqr. | 18.4 | 4.16 | 0.25 | 565 | 191 | 3.0112 | | |
| Conventional Square Blade | Sqr. | 18.7 | 4.16 | 0.28 | 635 | 189 | 4.8962 | | |
| Conventional Square Blade | Sqr. | 18.6 | 4.15 | 0.29 | 579 | 188 | 3.9619 | | |
| Mach: S = 0.030; D = 0.030 | M33 | 18.1 | 4.30 | 0.28 | 590 | 193 | 3.9234 | 0.0320 | 0.0253 |
| Mach: S = 0.030; D = 0.010 | M31 | 18.1 | 4.25 | 0.28 | 670 | 202 | 4.5551 | 0.0317 | 0.0075 |
| Mach: S = 0.010; D = 0.030 | M13 | 18.6 | 4.12 | 0.23 | 554 | 193 | 4.1193 | 0.0053 | 0.0275 |
| Mach: S = 0.010; D = 0.010 | M11 | 18.0 | 4.20 | 0.26 | 698 | 194 | 4.5025 | 0.0086 | 0.0073 |
| Grnd: S = 0.030; D = 0.030 | G33 | 18.3 | 4.25 | 0.23 | 543 | 216 | 3.7324 | 0.0219 | 0.0113 |
| Grnd: S = 0.010; D = 0.010 | G11 | 18.9 | 4.54 | 0.32 | 674 | 204 | 5.3687 | 0.0077 | 0.0233 |

As can be seen from Table 2, respectively, the sheets produced using the stepped creping blades achieved greater bulk and greater absorbency capacity, AGAT Cap, than the sheets produced using the conventional square creping blades. The average bulk of sheets produced using the stepped creping blades were 11 microns greater than the average bulk of the sheets produced using the conventional creping blades. The average absorbency capacity of the sheets produces using the stepped creping blades were 0.12 gw/gf greater than the sheets produced using the conventional square creping blades.

Figure 8A:
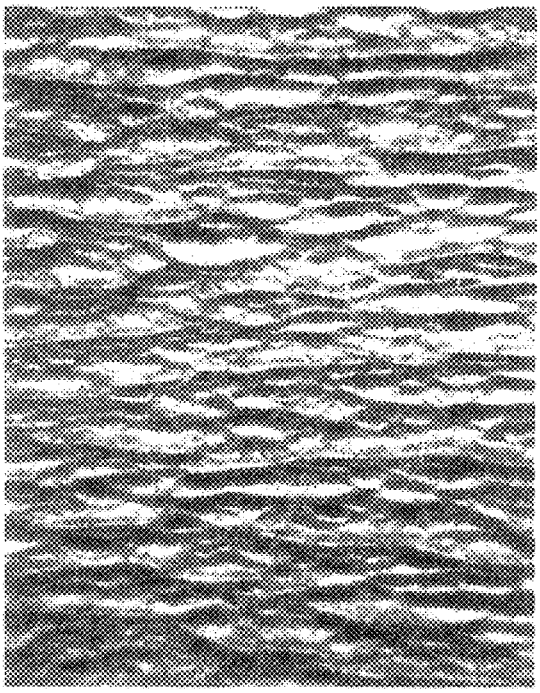
FIG. 8A is a low angle photomicrograph (8x) of a creped uncalendered sheet produced using a machined stepped creping blade in accordance with the present invention wherein a width of the top surface of the step is approximately 0.040 inches and a depth of the step is approximately 0.010 inches.
Figure 8B:
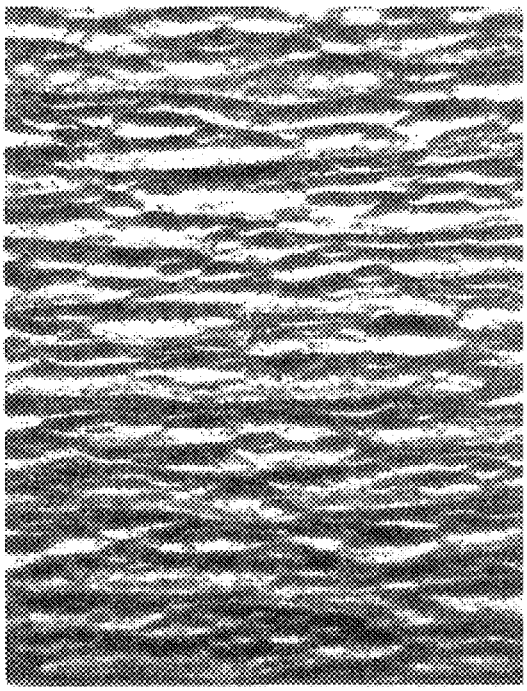
FIG. 8B is a low angle photomicrograph (8x) of a creped uncalendered sheet produced using a ground stepped creping blade in accordance with the present invention wherein a width of the top surface of the step is approximately 0.020 inches and a depth of the step is approximately 0.030 inches.

FIG. 8A is a low angle photomicrograph (8x) of a creped uncalendered sheet produced using the machined stepped creping blade, M13, (Mach: S=0.010; D=0.030) of the present invention wherein the width of the top surface of the step is approximately 0.040 inches, the depth of the step is approximately 0.030 inches. FIG. 8B is a low angle photomicrograph (8x) of a creped uncalendered sheet produced using the ground stepped creping blade G33.

Figure 8C:
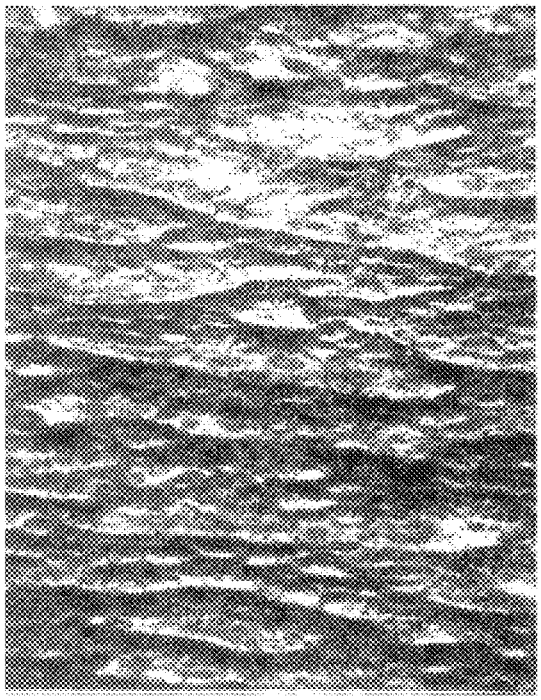
FIGS. 8C and 8D are low angle photomicrographs (8x) of creped uncalendered sheets produced using conventional square creping blades having a bevel of zero degrees.
Figure 8D:
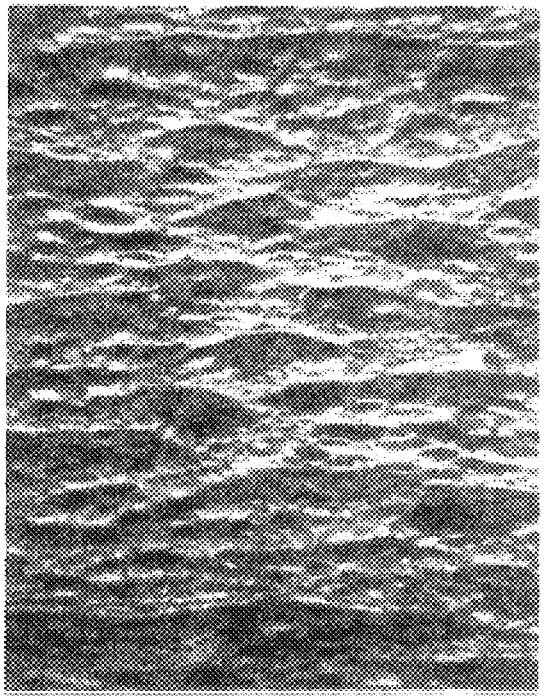

FIGS. 8C and 8D are low angle photomicrographs (8x) of creped uncalendered sheets produced using conventional square creping blades which have a bevel of zero degrees and a top surface width of approximately 0.050 inches.

The short direction of the photographs is the cross direction, CD, of the sheets. The long direction of the photographs is the machine direction, MD, of the sheets.

Figure 9A:
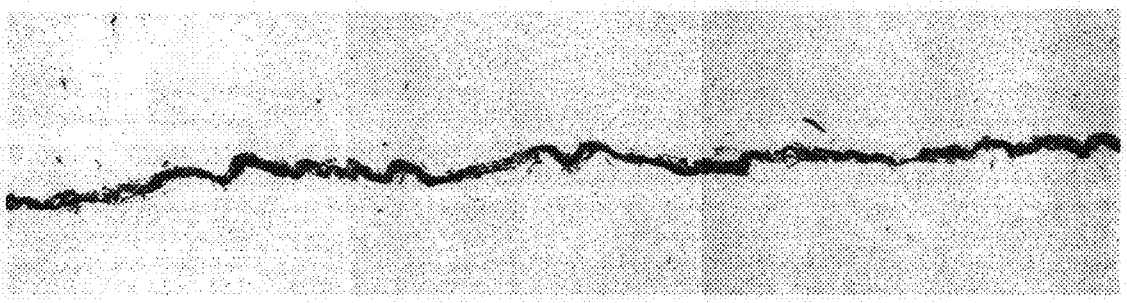
FIG. 9A is a machine direction profile of the creped sheet of FIG. 8C looking in the cross direction.
Figure 9B:
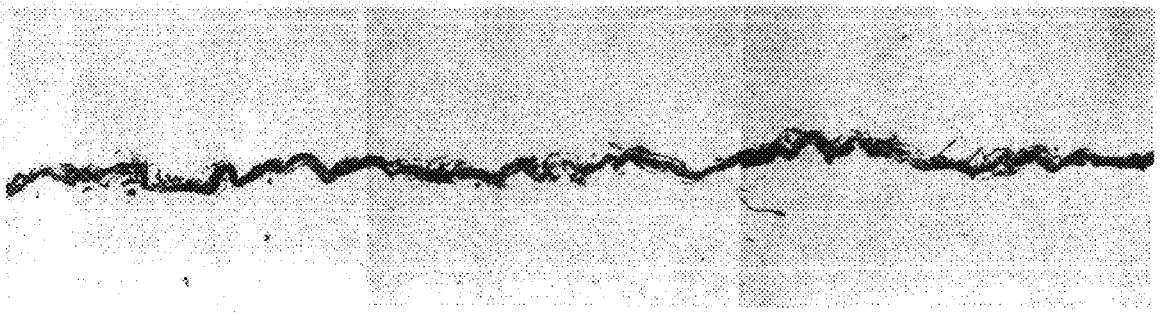
FIG. 9B is a machine direction profile of the creped sheet of FIG. 8A looking in the cross direction.

FIG. 9A is a machine direction profile of the creped sheet of FIG. 8C looking in the cross direction. FIG. 9B is a machine direction profile of the creped sheet of FIG. 8A looking in the cross direction. The creped sheet in FIG. 9B, produced with the stepped creping blade M13, is clearly more delaminated, has a larger internal void volume, and greater bulk than the creped sheet in FIG. 9A produced with the conventional square creping blade. The crepe structure, as represented by undulations of the sheet, are also slightly finer in FIG. 9B.

Accordingly, as can be seen from the foregoing, a process for producing a creped sheet including the steps of adhering a cellulosic web to a moving surface, providing a stepped creping blade disposed to crepe the cellulosic web from the moving surface and creping the cellulosic web from the moving surface forms a creped paper product having greater bulk and absorbency that previously prepared creped paper products. As noted hereinabove, the stepped creping blade used in carrying out the process of the present invention includes an elongated body adapted to be engagable against, and span the width of, the moving surface, the elongated body having a cross section including a relief surface generally facing toward the moving surface, a back surface substantially parallel to the relief surface and generally facing away from the moving surface, a top surface adjacent both the relief surface and a recessed surface with the recessed surface being adjacent both the top surface and the back surface and forming a contact edge with the top surface such that the contact edge engages against the moving surface for creping the cellulosic web from the moving surface. The top surface and the recessed surface form a back step edge while the recessed surface and the back surface form a trailing edge. When utilizing such a blade configuration, the process further includes the steps of first contacting the cellulosic web conveyed by the moving surface with the contact edge, then optionally contacting the cellulosic web creped by the contact edge with the back step edge and subsequently contacting the cellulosic web creped by the contact edge with the trailing edge.

While the present invention has been described with reference to a preferred embodiment, it should be appreciated by those skilled in the art that the invention may be practiced otherwise than is specifically described herein without departing from the spirit and scope of the invention. It is, therefore, to be understood that the spirit and scope of the invention be limited only by the appended claims.

What is claimed is:

1. A stepped creping blade for creping a cellulosic web from a moving surface by engaging the stepped creping blade substantially against the moving surface; said stepped creping blade comprising;

an elongated body, said elongated body having a front engaging surface for engaging said moving surfaces, an upper creping surface for creping the web, and a back surface; said upper creping surface including a substantially planar top initial crepin surface having a width of 20% to 60% of a total width of the stepped creping blade for initially the web and a recessed surface, said recessed surface including a side surface having a depth from 30% to 300% of said width of said top surface and a bottom subsequent creping surface for creping the web after the web is creped by said top initial creping surface with said side surface extending substantially parallel to said front engaging surface and substantially perpendicular to said bottom subsequent creping surface with said top initial creping surface extending substantially perpendicular to said front enaging surface.

2. The stepped creping blade of claim 1, wherein said top surface is angled with respect to said front surface.

3. A stepped creping blade for creping a cellulosic web from a moving surface, said stepped creping blade comprising an elongated body engagable against, and spanning the width of, the moving surface, said elongated body including;

a front surface generally facing toward the moving surface, a back surface substantially parallel to said front surface and generally facing away from the moving surface, a top surface adjacent said front surface and extending substantially perpendicular to said front surface said to surface having a of 20% to 60% of a total width of the stepped creping blade, and a recessed surface adjacent both said top surface and said back surface, said recessed surface including a side surface extending substantially parallel to said front surface having a depth from 30% to 300% of said width of said top surface and a bottom surface extending adjacent to and substantially perpendicular to said side surface;

said front surface and said top surface forming a contact edge wherebetween for initially creping the cellulosic web from the moving surface, said top surface and said recessed surface forming a back step edge therebetween for further creping the cellulosic web, and said recessed surface and said back surface forming a trailing edge therebetween for further creping the cellulosic web.

4. The stepped creping blade of claim 3, wherein a distance between said back step edge and said front surface is less than a distance between said back surface and said side surface.

5. A stepped creping blade for creping a cellulosic web from a moving surface by engaging the stepped creping blade substantially against the moving surface; said stepped creping blade comprising:

an elongated body, said elongated body having a front surface, an upper surface extending substantially perpendicular to said front surface, and a back surface extending substantially parallel to said front surface; with said upper surface including a substantially planar top surface having a width of 20% to 60% of a total width of the stepped creping blade and a recessed surface; said recessed surface including an arched surface having a depth from 30% to 300% of said width of said top surface extending from said top surface to said back surface thereby forming a contact edge between said front surface and said top surface, a back step edge between said top surface and said arched surface and a trailing edge between said arched surface and said back surface.

6. The stepped creping blade of claim 5, wherein said top initial creping surface is adjacent to and substantially perpendicular to said front surface.

* * * * *

UNITED STATES PATENT AND TRADEMARK OFFICE

CERTIFICATE OF CORRECTION

PATENT NO. : 6,027,614

DATED : February 22, 2000

INVENTOR(S) : Peter PARKER et al.

It is certified that error appears in the above-identified patent and that said Letters Patent is hereby corrected as shown below:

Column 9, line 18, change "1" to --5--.

Signed and Sealed this

Thirtieth Day of January, 2001

*Attest:*

Q. TODD DICKINSON

*Attesting Officer*

*Director of Patents and Trademarks*